US006604445B2

(12) United States Patent
Sevastian

(10) Patent No.: US 6,604,445 B2
(45) Date of Patent: Aug. 12, 2003

(54) GAS TRAP (GT) COMPENSATOR

(76) Inventor: Nicolae Radu Sevastian, 1095 Riverside Drive East, Windsor, Ontario (CA), N9A-2T6

( * ) Notice: Subject to any disclaimer, the term of this patent is extended or adjusted under 35 U.S.C. 154(b) by 0 days.

(21) Appl. No.: 09/794,994

(22) Filed: Feb. 28, 2001

(65) Prior Publication Data

US 2002/0117048 A1 Aug. 29, 2002

(51) Int. Cl.[7] ..... F41A 21/36
(52) U.S. Cl. ..... 89/14.3; 89/14.2; 42/1.06
(58) Field of Search ..... 89/14.3, 14.05, 89/14.5, 14.2, 14.4; 42/1.06, 79

(56) References Cited

U.S. PATENT DOCUMENTS

| | | | | | |
|---|---|---|---|---|---|
| 1,901,138 | A | * | 3/1933 | Barnes | 89/14.3 |
| 2,150,161 | A | * | 3/1939 | Green | 89/14.3 |
| 2,668,479 | A | * | 2/1954 | Batten | 42/79 |
| 2,712,193 | A | * | 7/1955 | Mathis | 42/79 |
| 2,859,444 | A | * | 11/1958 | Reymond | 227/8 |
| 3,177,771 | A | * | 4/1965 | McKim | 89/14.3 |
| 3,707,899 | A | * | 1/1973 | Perrine | 89/14.3 |
| 3,858,481 | A | * | 1/1975 | Elliott | 89/14.3 |
| 4,058,050 | A | * | 11/1977 | Brouthers | 89/14.3 |
| 4,429,614 | A | | 2/1984 | Tocco | |
| 4,715,140 | A | | 12/1987 | Rosenwald | |
| 5,105,717 | A | * | 4/1992 | Pond | 42/79 |
| 5,367,940 | A | * | 11/1994 | Taylor | 89/14.3 |
| 5,463,930 | A | * | 11/1995 | Bisping et al. | 89/14.3 |
| 5,814,757 | A | * | 9/1998 | Buss | 89/14.3 |

FOREIGN PATENT DOCUMENTS

| | | | | |
|---|---|---|---|---|
| CH | 332849 | * | 11/1958 | 89/14.3 |
| EP | 70612 | * | 1/1983 | 89/14.3 |
| GB | 465697 | * | 5/1937 | 89/14.3 |

* cited by examiner

*Primary Examiner*—Michael J. Carone
*Assistant Examiner*—Gabriel S Sukman
(74) *Attorney, Agent, or Firm*—Carrier, Blackman & Associates, P.C.; Joseph P. Carrier; William D. Blackman

(57) ABSTRACT

A Gas Trap (GT) barrel compensator used for reducing recoil and compensation for muzzle flip, experienced when firing a firearm has an improved compensating effect (downward force) achieved through a GT chamber provided adjacent to and communicating with the firearm barrel. One aspect of compensation is achieved by the release of exhaust gasses into the bottom of the chamber. A second aspect of compensation employs exhaust pressure build up in the GT chamber of gasses from the barrel, and venting of same outwardly of the firearm through ports in the GT chamber. A third aspect of compensation involves discharge of gasses from the barrel upwardly through barrel ports and the chamber ports. All three aspects of compensation can be "tuned" for a specific caliber, and style of gun by varying the size and number of the ports on the barrel and/or GT chamber, while the length of the barrel beyond the compensator has to allow the exhaust gasses to release all the pressure.

20 Claims, 3 Drawing Sheets

GAS TRAP (GT) COMPENSATOR

FIELD OF THE INVENTION

The present invention relates to fire arms, and more particularly to the compensation of the "muzzle flip" and recoil when firing.

BACKGROUND OF THE INVENTION

Barrel compensators and muzzle brake systems are well known in the industry and have applications in handguns, rifles and machine guns. When we fire a firearm the gas pressure will push the bullet down the barrel at high speed.

Due to the law of action and reaction, the reaction to the bullet's energy is the recoil. The recoil will push the gun towards the shooter's direction with a force proportional to the caliber and velocity of the bullet. Consequently if you want to shoot larger caliber bullets, faster, you have to expect greater recoil. The muzzle brake will reduce the recoil by gradually releasing the pressure produced by the blast through small perforations at the end of the barrel. This process takes place while the bullet is still in the barrel. Because the grip of a handgun is bellow the barrel, the recoil force will torque the gun in the hand of the shooter producing "muzzle flip". The muzzle flip (the upward motion of the hand and gun after firing) slows down the shooter by increasing the time to recover and line-up the sights on the next target. Competitive sports and tactical applications use the compensating effect of releasing the gasses through ports cut in the upper end of the barrel. These ports are called compensating ports and will exhaust the gases up rather than around the barrel, which will cause a downward force on the barrel. This force will aid in keeping the barrel on target, allowing the shooter to fire at a much faster rate while increasing accuracy. The compensators that are now on the market are extensions at the end of the barrel, their effectiveness is proportional to the number of inline compensating ports, this makes the gun longer, heavier and.more difficult to handle and carry.

Representative of the art is U.S. Pat. No. 4,207,799 to Charles T. Toco that discloses a bushing style of compensator which uses the upward exhaust of gases through a tubular attachment at the end of the barrel. Also representative of the art is U.S. Pat. No. 285,235. To Vito Cellini describing a compensator that is attached to the end of the barrel, and uses upward exhaust of gases through the ports at the end of the barrel.

Also representative of the art is U.S. Pat. No. 5,698,810 to Clyde E. Rose and assigned to Browning Arms Company describing a muzzle brake, ballistic optimizer system that is attached to the end of the barrel and is used to reduce recoil in rifles and tune the frequency of vibrations in rifles for higher accuracy.

Also representative of the art is U.S. Pat. No. 417,252. To Ira M. Kay describing a compensator that is attached to the end of a rifle's barrel, and uses upward exhaust of gases through the ports at the end of the barrel to hold the barrel down.

The prior art does not teach the compensating effect being achieved through the following three methods.

The prior art does not teach the use of a chamber to build up pressure. Also it does not teach how to use that pressure to obtain barrel compensation. (Called "Pressure compensation").

The prior art does not teach the use of exhaust gases to push down into a chamber attached to the barrel, therefore pushing the barrel down. (Called "Chamber compensation").

The prior art does not teach how to integrate classic compensation porting with "pressure compensation" and "chamber compensation". Also the prior art does not teach how to integrate all three compensating features described above in a very compact package included within the original length of the barrel, i.e. no barrel extensions.

What is needed is a compact "Gas Trap" chamber, that must be used around the end of the barrel with ports on the upper area.

What is needed is the chamber must be firmly attached to the barrel.

What is needed is the barrel must have multiple perforations in each of the four directions (up, down, left, right).

What is needed is that these perforations will be contained within at the end part of the barrel, and inside the chamber called the "Gas Trap".

The present invention meets these needs.

SUMMARY OF THE INVENTION

The primary aspect of the invention is to provide a compact chamber called Gas Trap around the end of the barrel Another aspect of the invention is to provide exhaust ports to the Gas Trap chamber, oriented upwards.

Another aspect of the invention is to provide means of attaching the Gas Trap chamber to the barrel, with or without any type of barrel bushing.

Another aspect of the invention is to provide perforations (ports) in four directions—up, down, left, right—in the section of the barrel that is contained inside the Gas Trap chamber.

Other aspects of the invention will be pointed out, or made obvious by the following description of the invention and the accompanying drawings.

The invention is a GT (Gas Trap) Compensator. Its purpose is to maximize the barrel compensation effect in a compact, efficient and unobtrusive package. By maintaining the barrel in a horizontal position while shooting, faster rates of fire can be achieved with higher accuracy. The GT Compensator will achieve this goal by combining three distinct methods of compensating barrel recoil, into one integrated system. The Gas Trap (GT) chamber is the element that makes the integration of the three methods possible. The compensation methods are described as follows:

1. The ports placed in the barrel that are aimed upwards will vent the gases up through the ports cut in the upper part of the Gas Trap chamber. The reaction to this action will be the gases pushing the barrel down. This is the classic compensation method.
2. The ports placed in the barrel that are located down at the bottom of the barrel will exhaust gases onto the bottom of the Gas Trap Chamber. Because the Gas Trap Chamber is attached to the barrel, the down force exerted onto the GT Chamber will force the barrel down providing the second compensating action called "Chamber Compensation".
3. The ports located on the bottom and to the left and right side of the barrel will exhaust gases into the GT Chamber. These gases will be characterized by a pressure P1 and a velocity V1. P1 will be dependent on the pressure released by the type of ammunition used.

P1 is determined by the ammunition and caliber used.

V1 is the velocity of the gases that exhaust through the ports in the barrel, while the bullet is obstructing the end of the barrel. V1 will be determined by the maximum diameter of the ports in the barrel, allowed by the safe functioning of the gun and the number of these ports. More ports with larger diameter will reduce the gas velocity through the ports, faster. This will increase the flow of gas exhausted inside the GT Chamber. The diameter of these ports should be up to a maximum of 0.218" per barrel port (for a caliber not lower than 0.38" or 9 mm). The safety factor can also be increased by reaming out the rifling in the area of the barrel that has the ports.

V2 is the velocity of the gases exhausted through the ports located on the top of the GT chamber. V2 can be controlled by variations of the area of the port openings on the top of the GT Chamber.

P2 is the pressure of the gases vented through the ports in the GT chamber. P2 will be the element that will determine the efficiency of this kind of compensation system.

To explain further I should say that, very high pressure P1 will cause the exhaust gases that are available, to vent inside the GT Chamber very fast (while the bullet is still in the barrel). If the area of the GT Chamber ports is small, the flow of the exhaust gas is slow at a relative high pressure P2 and the compensating force does not have enough time to be effective. This means that sufficient pressure is still in the barrel after the bullet exits. This pressure will be released through the end of the barrel producing unwanted recoil. To maximize the compensation in this case we should open the ports of the GT chamber as much as possible so that in the short time when the bullet obstructs the end of the barrel we vent out most of the pressure through the top ports of the GT Chamber. This reduces P2 but will allow most of the gases to exhaust through the top ports of the GT chamber maximizing the compensation.

Opposite if the P1 pressure is to low, there will not be enough force (pressure) to have a strong compensating effect.

To increase the compensating force, the ports on top of the GT camber must be reduced to increase the pressure build-up P2 of the gases in the GT chamber before they are vented up. For this case the time is not a factor because of the lower velocity V1 of both the bullet and the gases.

Therefore this P2 value is to be determined for each caliber and also for each power factor of the ammunition being used. This aspect of the invention is part of the process called "tuning" of the compensator to the specifics of the application.

The variation of V2 by changing the opening of the GT chamber ports, will determine the amount of compensation force and will optimize P2. This will be achieved by means of increasing or decreasing the opening surface of the ports, on the upper part of the GT chamber.

The principle of operation and the "tuning" process is explained by the following example:

45 ACP Cal. has low operating pressures (chamber pressure) P1. To "tune" a 45 cal GT Compensated barrel you will keep the ports in the top of the GT Chamber smaller so that you can build P2 to higher values and maximize the efficiency. 45 ACP is a slow velocity cartridge and we need to increase the compensating force by increasing P2.

38 Super Cal. that operates at high chamber pressures p1, will be "tuned" by opening more, the ports in the top of the GT Chamber. By doing this, we increase the flow of the gases exhausted. The result is that we decrease P2, to effective levels for maximum compensating effect, by venting up almost all the exhaust gas, that otherwise would have generated recoil. This compensating effect is called "Pressure Compensation" and the force down on the barrel is controlled by releasing the P2 pressure, through the surface of the GT chamber ports. The variation of that surface will have a tuning effect of the GT Compensator to the ammunition and the type of gun that is used.

BRIEF DESCRIPTION OF THE DRAWINGS

The accompanying drawings, which are incorporated in and form a part of the specification, illustrates preferred embodiments of the present invention, and together with a description, serve to explain the principles of the invention.

DETAILED DESCRIPTION OF THE PREFERRED EMBODIMENT

Figure 5:
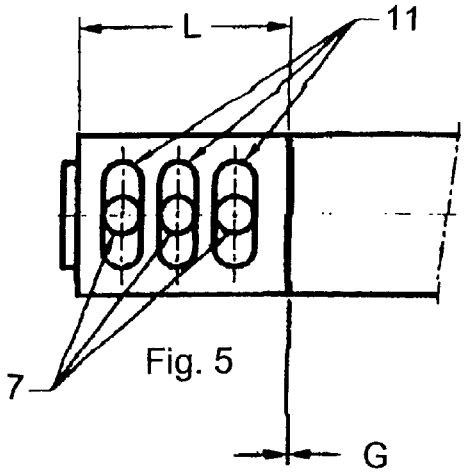
FIG. 5 is a top view of the inventive GT Compensator.
Figure 6:
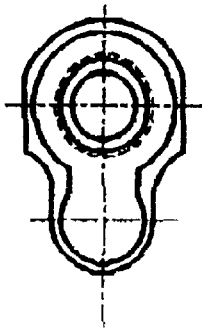
FIG. 6 is a front view of the inventive GT Compensator.

FIG. 5 depict the GT Compensator designed for a 1911 Colt Government Model Pistol. The prototype and the tests were conducted on this model of handgun.

Figure 3:
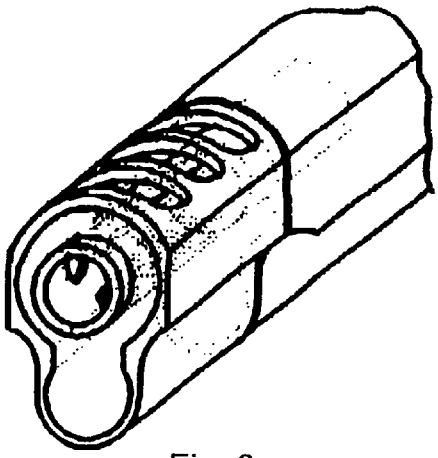
FIG. 3 is an isometric of the inventive GT Compensator.
Figure 4:
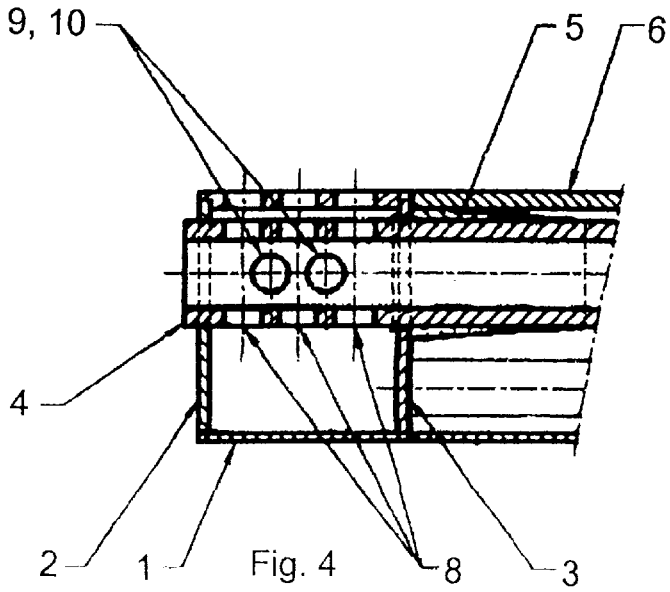
FIG. 4 is a sectional view of the GT Compensator in FIG. 3.

FIG. 4 shows three slotted profiles of the ports (11) on the upper side of the GT Chamber. Also one can see the circular ports, drilled on the upper (7), and three lower ports (8). The length L represents the length of the GT Chamber (1); also one can identify item 6, with an Officer's model Colt 1911 style slide. The Officer slide is a shorter slide then the standard slide. The difference between officer's slide and standard Government Model is 1.13 to 1.20 inches. This difference is equal with length L illustrated in FIG. 3. This will show that the standard model overall length will not be changed by the usage of this device.

Figure 1:
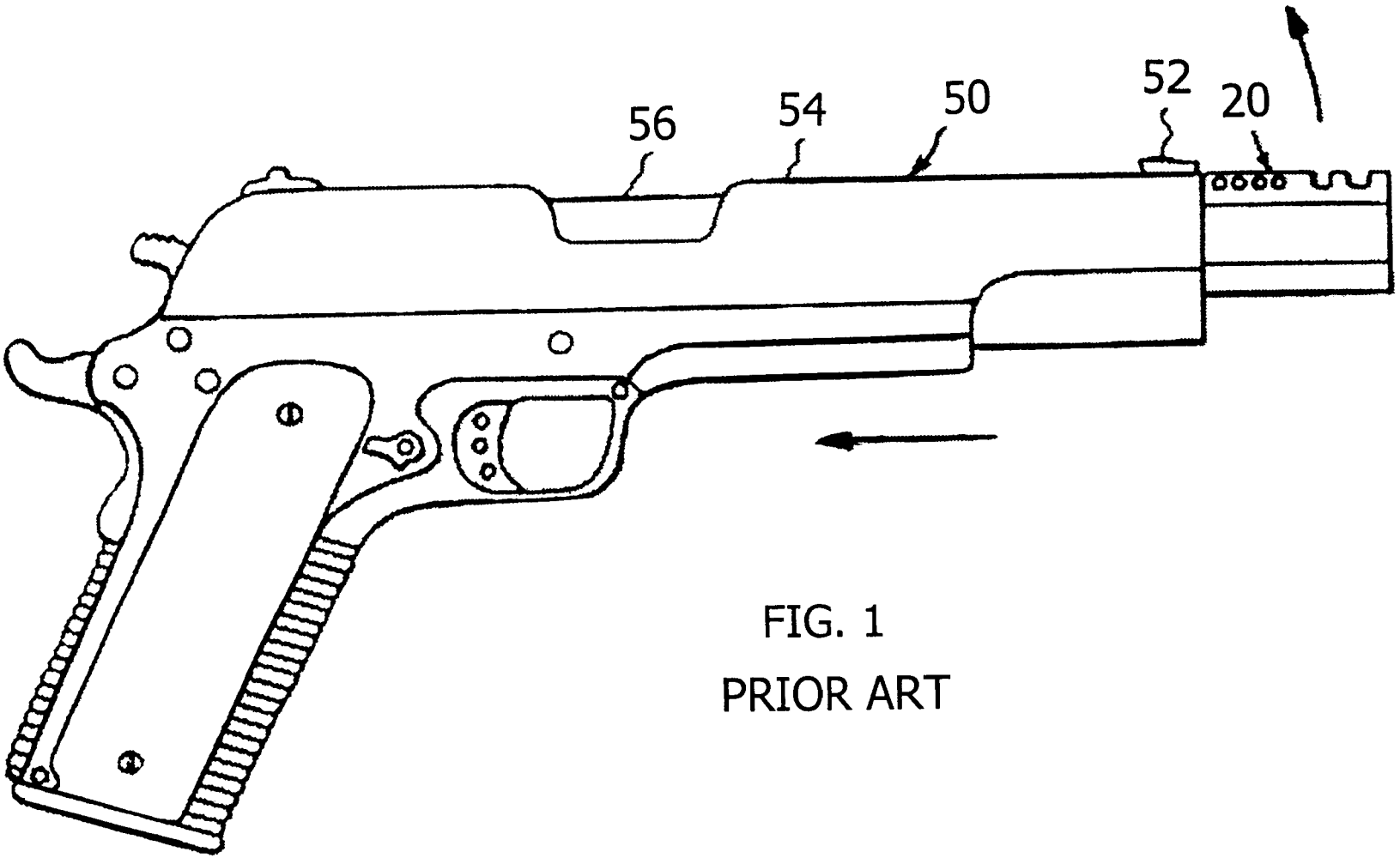
FIG. 1 PRIOR ART
FIG. 1 is a section view of the prior art called compensator. One can see that the device is an extension to the end of the barrel.
Figure 2:
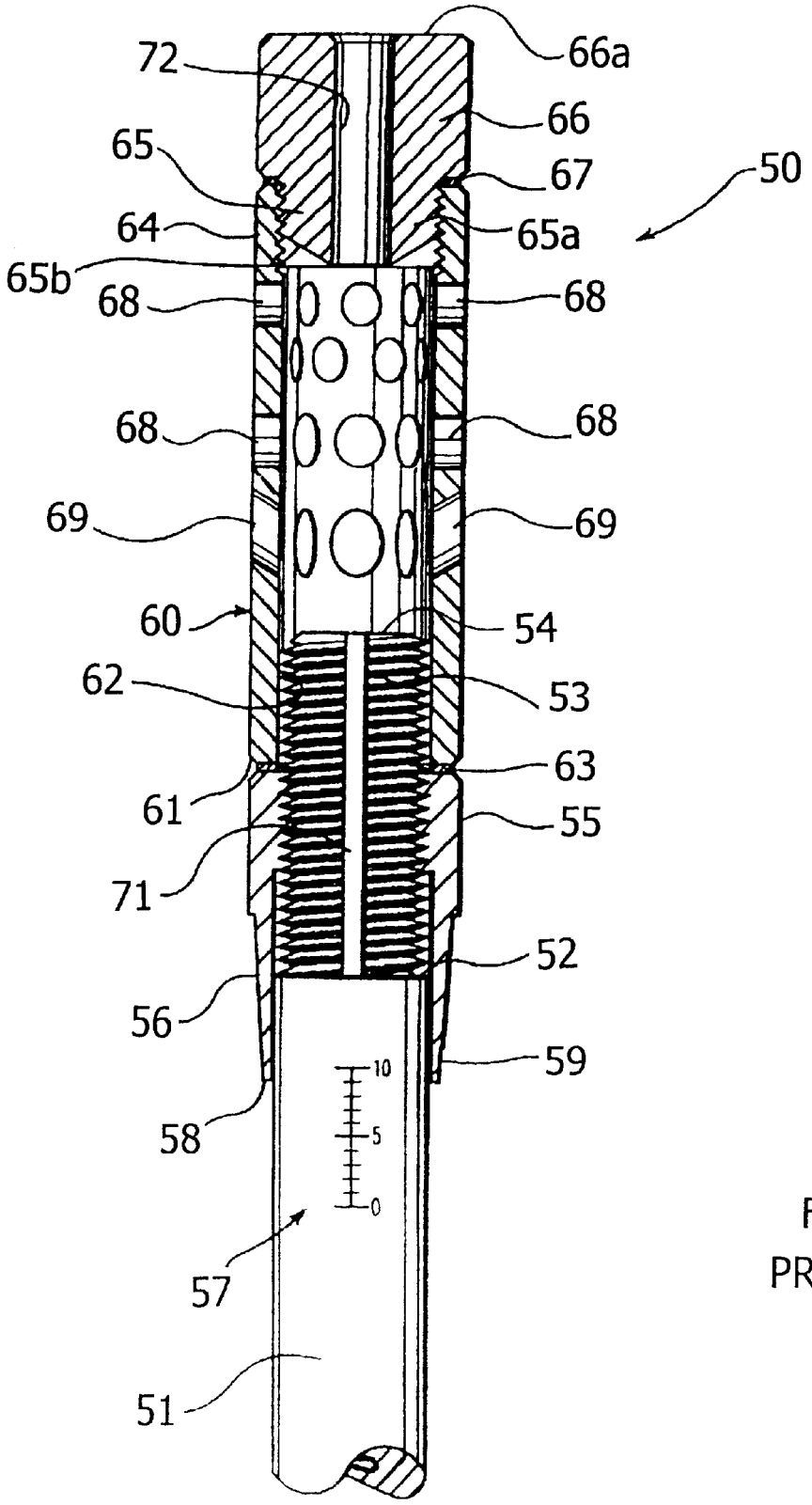
FIG. 2 PRIOR ART
FIG. 2 is a section view of the prior art called muzzle brake. One can see the perforations are all around the end of the barrel.

FIG. 1 shows a section through the barrel (4), bushing (5), slide (6) and GT Chamber (1). Here o)e will see the front baffle (2) and the rear baffle (3) that will close the GT Chamber. The two baffles have similar profile as shown in FIG. 5. Also FIG. 3 shows on the Right Hand side holes (9), and two more on the Left Hand side (10), four altogether on both sides of the barrel. In the bushing (5) is threaded (or press fitted) on the barrel (4). On the front of the bushing the rear baffle is welded solid. The GT Chamber's body has the same cross-section as the slide, and is welded (or solid) to the rear baffle. Both welds are faced clean. The gap G is fitted to be no more than 0.010" at this stage. The front baffle is now fitted to the GT Camber and the barrel. The GT Camber assembly is removed from the end of the barrel, and the front baffle is welded at the end of the GT Camber. The GT Compensator assembly in now clean faced and assembled back on the barrel. The front baffle is silver soldered on the barrel and the final assembly is now complete. The GT Compensator will also require that the spring, guide rod and reverse plunger will be changed with components from an officer's model 1911 style pistol.

Although a single form of the invention has been described herein, it will be obvious to those skilled in the art, that variations may be made in the construction and relation of parts without departing from the spirit and scope of the invention described herein. Also the same principle described here may be applied to function in a different embodiment that might be on another brand, style or model of a handgun (pistol or revolver) and/or rifle, shotgun, semi-automatic, or fully automatic weapon.

Abstract of the Disclosure

The invention is a Gas Trap (GT) barrel Compensator used for reducing recoil and compensation for muzzle flip, experienced when firing a firearm. The compensating effect is achieved through three methods, within the GT chamber. The classic compensation is accompanied by GT Pressure compensation and GT Chamber compensation.

The Classic compensation is achieved by exhausting high pressure gas through the upper ports in the barrel and through the ports in the GT Chamber. The release of gases will push the barrel down.

The GT Chamber compensation is achieved by the release of exhaust gases into the bottom of the chamber, creating a downward force thus pushing the barrel down.

The GT Pressure compensation employs the exhaust pressure build up in the GT Chamber which is created by the exhaust gases from in the barrel, and venting through the ports in the GT chamber thus pushing the barrel down.

All three can be "tuned" for a specific caliber, and style of gun. The tuning process is achieved by varying the size and number of the ports on the barrel and/or GT Camber. Also, for maximum efficiency the length of the barrel beyond the compensator has to allow the exhaust gasses to release all the pressure.

I claim:

1. A muzzle flip compensating device for a firearm having a barrel, comprising:

a hollow chamber surrounding a portion of the firearm barrel;

a plurality of communication ports between said barrel and said chamber; and at least one discharge port provided in a wall of said chamber for exhausting discharge gasses outwardly of said firearm;

at least one of said communication ports opening directly into said discharge port, and another of said communication ports opens away from said discharge port; and all said discharge ports exhaust said discharge gasses substantially upwardly of said firearm.

2. A muzzle flip compensating device according to claim 1, wherein said communication ports extend in multiple directions around said barrel.

3. A muzzle flip compensating device according to claim 2, wherein said communication ports include at least one port defined in each of an upper surface, a lower surface and a side surface of said barrel.

4. A muzzle flip compensating device according to claim 1, wherein at least one of said communication ports opens downwardly into a portion of said chamber.

5. A muzzle flip compensating device according to claim 1, wherein said communication ports are smaller in size than said discharge port.

6. A muzzle flip compensating device according to claim 1, wherein said firearm is a handgun.

7. A muzzle flip compensating device according to claim 1, wherein said firearm is a handgun and said compensating device has a longitudinal length of approximately 1.25 inches or less.

8. A muzzle flip compensating device according to claim 1, wherein said firearm is a handgun, said handgun including a slide surrounding a portion of said barrel, and said compensating device extends continuously from said slide and has an outer shape which is substantially the same as that of said slide.

9. A muzzle flip compensating device according to claim 1, wherein said firearm is a handgun and a free end of said barrel extends to at least a free end of said compensating device.

10. A muzzle flip compensating device according to claim 1, wherein said firearm is a handgun and a free end of said barrel extends beyond a free end of said compensating device.

11. A muzzle flip compensating device for a firearm having a barrel comprising:

a hollow chamber disposed adjacent to a portion of the firearm barrel;

a plurality of communication ports provided in said barrel and facing said chamber such that discharge gasses in said barrel can flow into said chamber; and a discharge port provided in a wall of said chamber for exhausting discharge gasses outwardly of said firearm;

said discharge port being provided in a portion of the wall of said chamber which does not face at least one said communication port, and another of said communication ports opens directly into said discharge port; and wherein substantially all said discharge gasses flowing through said communication ports into said chamber are discharged substantially upwardly from said chamber.

12. A muzzle flip compensating device according to claim 11, wherein said chamber includes a first open space disposed concentrically around said barrel and a second open space communicating with said first open space and diposed beneath said first open space, and said communication ports open into said open spaces.

13. A muzzle flip compensating device according to claim 12, wherein said discharge port is disposed above an upper surface of said barrel.

14. A muzzle flip compensating device according to claim 11, wherein said firearm is a handgun.

15. A muzzle flip compensating device according to claim 11, wherein said firearm is a handgun and said compensating device has a longitudinal length of approximately 1.25 inches or less.

16. A muzzle flip compensating device according to claim 11, wherein said firearm is a handgun, said handgun including a slide surrounding a portion of said barrel, and said compensating device extends continuously from said slide and has an outer shape which is substantially the same as that of said slide.

17. A muzzle flip compensating device according to claim 11, wherein said firearm is a handgun and a free end of said barrel extends to at least a free end of said compensating device.

18. A muzzle flip compensating device according to claim 11, wherein said firearm is a handgun and a free end of said barrel extends beyond a free end of said compensating device.

19. A muzzle flip compensating device for a handgun having a barrel, comprising:

a hollow chamber surrounding a portion of the barrel;

a plurality of communication ports between said barrel and said chamber; and at least one discharge port provided in a wall of said chamber for exhausting discharge gasses outwardly of said handgun;

said chamber includes a first open space disposed concentrically around said barrel and a second open space communicating with said first open space and disposed beneath a bottom surface of said barrel;

at least one of said communication ports opening directly into said discharge port, at least one of said communication ports opens directly into said first open space, and at least one of said communication ports opens directly into said second open space;

and said compensating device is integrally, permanently fixed to said barrel;

said handgun including a slide surrounding a portion of said barrel; and said compensating device extends continuously from said slide and has an outer shape which is substantially the same as that of said slide.

20. A muzzle flip compensating device according to claim 19, wherein said firearm is a handgun and said compensating device has a longitudinal length of approximately 1.25 inches or less.

* * * * *